US005478377A

United States Patent [19]

Scavnicky et al.

[11] Patent Number: 5,478,377

[45] Date of Patent: Dec. 26, 1995

[54] FILTER FOR A RESPIRATORY DEVICE

[75] Inventors: John A. Scavnicky, Joppa, Md.; Corey M. Grove, Red Lion, Pa.

[73] Assignee: The United States of America as represented by the Secretary of the Army, Washington, D.C.

[21] Appl. No.: 281,802

[22] Filed: Jul. 22, 1994

[51] Int. Cl.[6] ..... B03C 3/30

[52] U.S. Cl. ..... 96/17; 55/279; 55/486; 55/528; 55/DIG. 33; 55/DIG. 35; 96/55; 96/154; 128/206.17; 422/122

[58] Field of Search ..... 96/154, 16, 17, 96/57, 58, 55; 55/527, 528, 279, DIG. 33, DIG. 35, DIG. 39, 485, 486; 422/120, 122; 128/206.12, 206.17

[56] References Cited

U.S. PATENT DOCUMENTS

| | | | |
|---|---|---|---|
| 4,141,703 | 2/1979 | Mulchi | 55/DIG. 33 |
| 4,294,599 | 10/1981 | Grovesteen et al. | 55/DIG. 35 |
| 4,350,662 | 9/1982 | Dowgul et al. | 55/DIG. 33 |
| 4,510,193 | 4/1985 | Blucher et al. | 96/154 X |
| 4,643,182 | 2/1987 | Klein | 55/DIG. 35 |
| 4,867,770 | 9/1989 | Feeney | 55/DIG. 33 |
| 4,921,512 | 5/1990 | Maryyanek et al. | 55/527 X |
| 5,063,926 | 11/1991 | Forsgren et al. | 55/DIG. 35 |
| 5,112,677 | 5/1992 | Tani et al. | 55/DIG. 39 |
| 5,221,573 | 6/1993 | Baigas, Jr. | 55/DIG. 39 |
| 5,240,479 | 8/1993 | Bachinski | 55/DIG. 33 |
| 5,304,419 | 4/1994 | Shores | 96/154 X |
| 5,350,443 | 9/1994 | von Blucher et al. | 96/154 X |

FOREIGN PATENT DOCUMENTS

| | | | |
|---|---|---|---|
| 164205 | 8/1964 | U.S.S.R. | 55/DIG. 33 |
| 2032298 | 5/1980 | United Kingdom | 96/154 |
| 2254017 | 9/1992 | United Kingdom | 55/DIG. 33 |

*Primary Examiner*—Richard L. Chiesa
*Attorney, Agent, or Firm*—Saul Elbaum; Edward L. Stolarun

[57] ABSTRACT

Disclosed is a filter for a reduced threat chemical/biological protective respiratory device which includes a housing having an air intake orifice and an air exit orifice and which encloses a filtering element which includes a plurality of bonded spherical carbon beads arranged in a open cell type matrix. The filtering element also includes an aerosol and particulate filtering element which is a plurality of electrostatically charged polypropylene fibers.

5 Claims, 2 Drawing Sheets

FILTER FOR A RESPIRATORY DEVICE

BACKGROUND OF THE INVENTION

1. Field of the Invention

The present invention relates to a gas-aerosol filter for chemical/biological protective mask and methods for use and, more particularly, to a plastic type of canister system which houses carbon beads attached to a reticulated foam and an electrostatically charged aerosol/particulate filter.

2. Brief Description of the Prior Art

It is desirable that respiratory devices designed for military use have low profiles, be resistant to having faceseals broken during operational conditions and have relatively low airflow resistance. The United States Army's M17 chemical/biological protective mask uses a dual filter system which has the filters mounted on the cheeks of the respiratory protective device. While this mask design afforded a low profile, it was abandoned during the development of the M40 protective mask in order to provide a canister type system which is NATO compatible and provides a higher level of vapor protection.

The standard canister used with the M40 chemical/biological protective mask has an airflow resistance of approximately 45 mm of water at an airflow rate of 85 liters per minute. Limitations in technology and threat requirements have prevented further reductions in resistances. Reductions in these resistances are desirable since it is found that higher resistances increase physiological burden at higher work rates.

SUMMARY OF THE INVENTION

It is an object of the present invention to provide a filter for a reduced threat chemical/biological protective mask and method for use in which defense against blood agents is not required which allows for a low profile mask configuration.

It is a further object of the present invention to provide a filter for a reduced threat chemical/biological protective mask and a method for use which contributes in resisting the breaking of the faceseal of the mask.

It is a still further object of the present invention to provide a filter for a reduced threat chemical/biological protective mask and a method of use which contributes to a relatively low airflow resistance in the mask.

The filter of the present invention comprises a housing having an air intake means and an air exit means and which encloses a filtering element which includes a plurality of bonded carbon beads arranged in an open cell type matrix. The filtering element also includes an aerosol and particulate filtering means which is preferably a plurality of electrostatically charged polymeric fibers.

BRIEF DESCRIPTION OF THE DRAWINGS

The filter for a reduced threat chemical/biological protective mask of the present is further described with reference to the accompanying drawings in which.

DETAILED DESCRIPTION OF THE PREFERRED EMBODIMENTS

Figure 1:
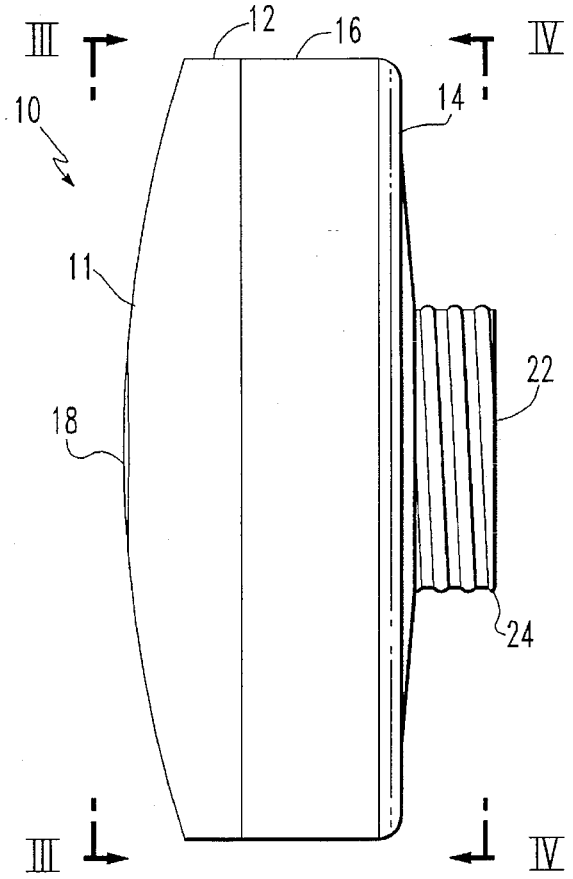
FIG. 1 is a side elevational view of the filter of the present invention.
Figure 2:
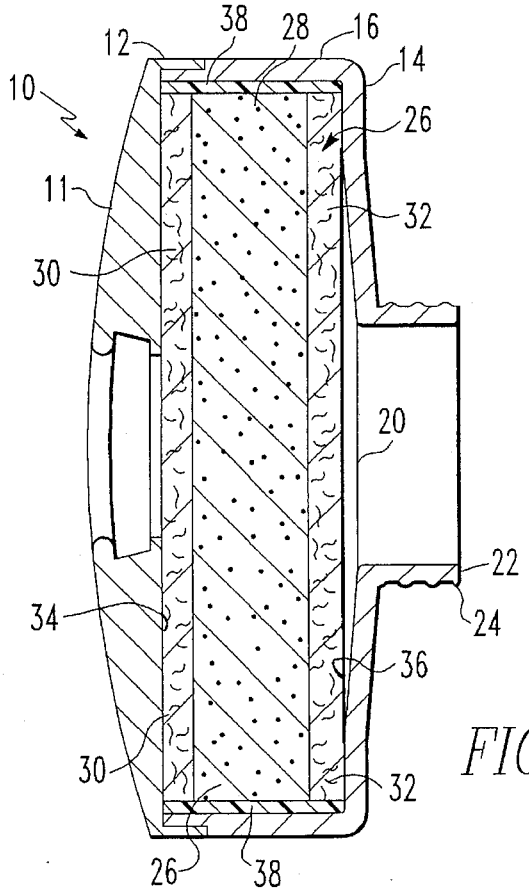
FIG. 2 is a vertical cross-sectional view of the filter shown in FIG. 1.
Figure 3:
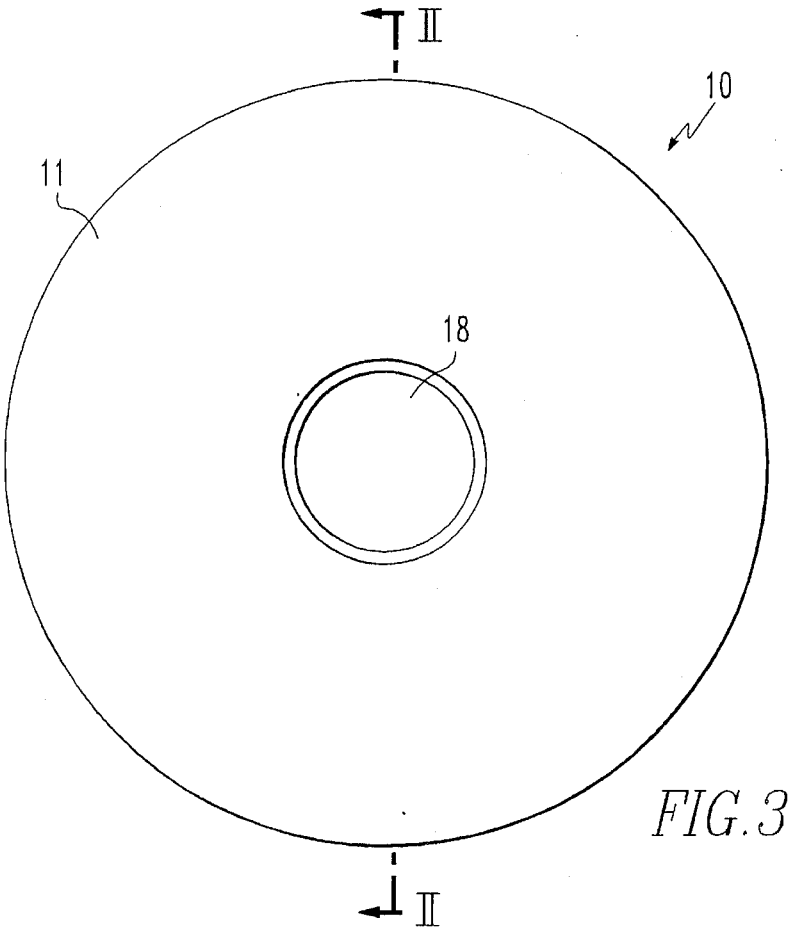
FIG. 3 is a front view of the filter shown in FIG. 1.
Figure 4:
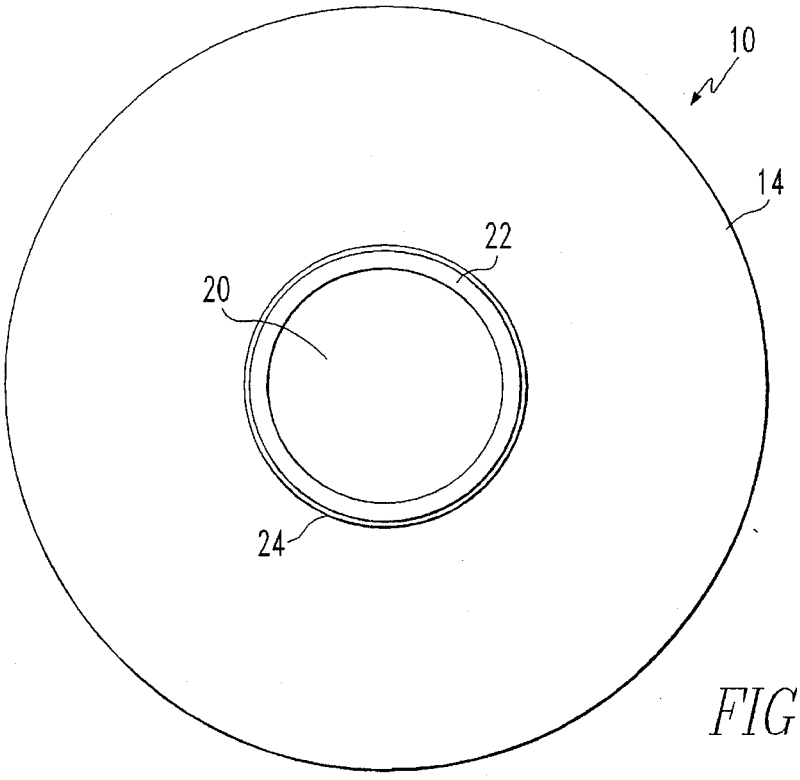
FIG. 4 is a rear view of the filter shown in FIG. 1.

Referring to the drawing, the filter for a protective respiratory device comprises a housing shown generally at numeral 10. The housing is generally cylindrical in shape and includes a front end wall 11 which has a lateral peripheral flange 12 and a rear end wall 14 which has a tubular lateral wall 16 which connects to the peripheral flange 12. The housing is preferably a composite material which is fabricated from a glass filled nylon material that provides chemical, solvent and decontamination resistance at a reduced weight. The components of the housing would preferably be welded together by spin welding, ultrasonic welding or radio frequency welding. The front end wall has a central air intake orifice 18, and the rear end wall has a central air exit orifice 20 from which there projects a tubular connecting fixture 22 which connects the filter to a mask by means of an exterior peripheral screw thread 24.

Inside the housing there is a filtering section shown generally at numeral 26. This filtering section includes a disc-shaped element of bonded carbon beads 28. These bonded carbon beads are arranged in a matrix and preferably an open cell type matrix. The carbon beads are also preferably spherical in shape and are from about 0.2 mm to about 0.8 mm in diameter. The carbon beads are attached to a reticulated foam resulting in a 75 weight percent of carbon. Suitable carbon beads and matrices are available from Blucher GMBH Parkstrasse 10, 4006 Erbrath, Germany under the product number T301-11. The filter section also includes a front aerosol and particulate filtering disc-shaped element 30 and a rear aerosol and particulate filtering disc-shaped element 32. These aerosol and particulate disc-shaped elements are comprised of polymeric fibers which are preferably a polypropylene fiber that is electrostatically charged. A suitable fiber is available from the 3M Corporation under the product number FILTRETE G-0130. The fibers will preferably be from about 10 microns to about 40 microns in diameter. The fibers will also preferably be packed to a density of 300 grams per square meter.

It will be observed from the drawing that the bonded carbon bead element is interposed between the front aerosol and particulate filtering element and the rear aerosol and particulate filtering element. It will also be seen that the disc-shaped front and rear aerosol and particulate filtering elements and the disc-shaped matrix of carbon beads peripherally abut the tubular lateral wall of the housing. The disc-shaped front and rear aerosol and particulate filtering elements also respectively adjoin the front and rear terminal ends of the housing end to end. A front low resistance fiberglass screen 34 is interposed between the disc-shaped front aerosol and particulate filtering elements and the front terminal end wall of the housing. A rear low resistance fiberglass screen 36 is interposed between the disc-shaped rear aerosol and particulate filtering elements and the rear terminal end wall of the housing. The disc-shaped front and rear aerosol and particulate filtering elements and the disc-shaped carbon bead matrix are fixed at their peripheral edges to the tubular lateral wall of the housing by means of a layer of a sealant 38 which is preferably a room temperature vulcanized (RTV) silicone which is available from Dow Corning Corporation under product number Q3-6093.

It will be appreciated that a method for treating air contaminated with chemical and/or biological agents has also been described in which such air passes through the filter and respiratory device herein described.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A lightweight filter for a protective respiratory device comprising:

a substantially cylindrical housing having an air intake means and an air exit means at opposed ends thereof;

filter means within said housing;

said filter means including a pair of aerosol and particulate filtering means, each of said aerosol and particulate filtering means comprising a disc-shaped, electrostatically charged filtering element formed of polymeric fibers;

a low resistance fiberglass screen interposed between one of said aerosol and particulate filtering means and said air intake means of said housing;

another low resistance fiberglass screen interposed between the other of said aerosol and particulate filtering means and said air exit means of said housing;

said filter means further including a disc-shaped filter element interposed between said pair of aerosol and particulate filtering means and including a plurality of carbon beads arranged in a matrix and attached to a reticulated foam member; and said pair of aerosol and particulate filtering means and said disc-shaped filter element are fixed to an interior wall of said housing by means of a sealant.

2. The filter of claim 1 wherein:

the bonded carbon beads are substantially spherical in shape with diameters from about 0.2 millimeters to about 0.8 millimeters and are arranged in an open cell matrix.

3. The filter of claim 1 wherein:

the polymeric fibers of said aerosol and particulate filtering means are polypropylene fibers which are from about 10 microns to about 40 microns in diameter and which are packed to a density of about 300 grams per square meter.

4. The filter of claim 1 wherein:

the housing is formed of a glass filled nylon material; and said sealant is a room temperature vulcanized silicone.

5. The filter of claim 1 wherein:

the housing has opposed first and second terminal ends with a tubular lateral wall interposed between said terminal ends; and each of the pair of the disc-shaped aerosol and particulate filtering means and the disc-shaped filter element abut the tubular lateral wall of the housing.

* * * * *